US008919439B2

(12) United States Patent
Grigsby et al.

(10) Patent No.: US 8,919,439 B2
(45) **Date of Patent: *Dec. 30, 2014**

(54) SINGLE TRIP MULTI-ZONE COMPLETION SYSTEMS AND METHODS

(71) Applicant: Halliburton Energy Services, Inc., Houston, TX (US)

(72) Inventors: Tommy Frank Grigsby, Katy, TX (US); William Mark Richards, Flower Mound, TX (US)

(73) Assignee: Haliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/894,830

(22) Filed: May 15, 2013

(65) Prior Publication Data

US 2014/0083682 A1 Mar. 27, 2014

Related U.S. Application Data

(63) Continuation of application No. 13/885,502, filed as application No. PCT/US2012/057257 on Sep. 26, 2012, now Pat. No. 8,746,337.

(51) Int. Cl.

| | |
|---|---|
| ***E21B 47/00*** | (2012.01) |
| ***E21B 34/10*** | (2006.01) |
| ***E21B 43/08*** | (2006.01) |
| ***E21B 43/26*** | (2006.01) |
| ***E21B 43/04*** | (2006.01) |
| ***E21B 43/14*** | (2006.01) |

(52) U.S. Cl.

CPC ..... *E21B 34/10* (2013.01); *E21B 43/08* (2013.01); *E21B 43/261* (2013.01); *E21B 47/00* (2013.01); *E21B 43/04* (2013.01); *E21B 43/14* (2013.01); *E21B 43/26* (2013.01)

USPC ..... 166/250.01; 166/373; 166/369

(58) Field of Classification Search

USPC ..... 166/250.01, 313, 278, 51, 250.17, 369, 166/373

See application file for complete search history.

(56) References Cited

U.S. PATENT DOCUMENTS

| | | | |
|---|---|---|---|
| 4,615,388 | A | 10/1986 | Walhaug et al. |
| 4,628,995 | A | 12/1986 | Young et al. |

(Continued)

FOREIGN PATENT DOCUMENTS

| | | | |
|---|---|---|---|
| WO | 03/080993 | A1 | 10/2003 |
| WO | 2005/045174 | A2 | 5/2005 |
| WO | 2012112657 | A2 | 8/2012 |

OTHER PUBLICATIONS

International Search Report and Written Opinion for PCT/US2012/057257 dated Apr. 23, 2013.

(Continued)

*Primary Examiner* — David Andrews
*Assistant Examiner* — Taras P Bemko
(74) *Attorney, Agent, or Firm* — Scott Richardson; Baker Botts L.L.P.

(57) ABSTRACT

Disclosed are systems and methods of producing from multiple production zones with a single trip multi-zone completion system. One method includes arranging an outer completion string within an open hole section of a wellbore, the outer completion string having at least one sand screen disposed thereabout, extending a production tubing within the outer completion string, the production tubing having at least one interval control valve disposed thereon, communicably coupling the production tubing to the completion string at a crossover coupling having one or more control lines coupled thereto, actuating the at least one interval control valve to initiate production into the production tubing at the at least one interval control valve, and measuring one or more fluid and/or well environmental parameters external to the outer completion string with a surveillance line communicably coupled to one or more control lines at the crossover coupling.

19 Claims, 1 Drawing Sheet

(56) References Cited

U.S. PATENT DOCUMENTS

| | | | | |
|---|---|---|---|---|
| 4,678,035 | A | 7/1987 | Goldschild | |
| 4,806,928 | A | 2/1989 | Veneruso | |
| 4,949,788 | A | 8/1990 | Szarka et al. | |
| 5,547,029 | A * | 8/1996 | Rubbo et al. | 166/375 |
| 5,921,318 | A | 7/1999 | Ross | |
| 6,247,536 | B1 | 6/2001 | Leismer et al. | |
| 6,253,857 | B1 | 7/2001 | Gano | |
| 6,257,332 | B1 | 7/2001 | Vidrine et al. | |
| 6,257,338 | B1 * | 7/2001 | Kilgore | 166/387 |
| 6,446,729 | B1 | 9/2002 | Bixenman et al. | |
| 6,523,609 | B1 | 2/2003 | Miszewski | |
| 6,575,237 | B2 | 6/2003 | Purkis et al. | |
| 6,629,564 | B1 | 10/2003 | Ramakrishnan et al. | |
| 6,655,452 | B2 | 12/2003 | Zillinger | |
| 6,684,951 | B2 | 2/2004 | Restarick et al. | |
| 6,712,149 | B2 | 3/2004 | Leismer et al. | |
| 6,983,796 | B2 | 1/2006 | Bayne et al. | |
| 7,055,598 | B2 | 6/2006 | Ross et al. | |
| 7,165,892 | B2 | 1/2007 | Grigsby et al. | |
| 7,222,676 | B2 | 5/2007 | Patel et al. | |
| 7,228,912 | B2 | 6/2007 | Patel et al. | |
| 7,273,106 | B2 | 9/2007 | Huckabee et al. | |
| 7,278,486 | B2 | 10/2007 | Alba et al. | |
| 7,306,043 | B2 | 12/2007 | Toekje et al. | |
| 7,377,321 | B2 | 5/2008 | Rytlewski | |
| 7,428,932 | B1 | 9/2008 | Wintill et al. | |
| 7,735,555 | B2 | 6/2010 | Patel et al. | |
| 7,900,705 | B2 | 3/2011 | Patel | |
| 7,950,454 | B2 | 5/2011 | Patel et al. | |
| 7,950,461 | B2 | 5/2011 | Schrader et al. | |
| 7,966,875 | B2 | 6/2011 | Proett et al. | |
| 8,079,419 | B2 | 12/2011 | Richards | |
| 8,082,998 | B2 | 12/2011 | Richards | |
| 2003/0079878 | A1 | 5/2003 | Pramann et al. | |
| 2003/0221829 | A1 * | 12/2003 | Patel et al. | 166/278 |
| 2003/0226665 | A1 | 12/2003 | Jones et al. | |
| 2004/0035591 | A1 | 2/2004 | Echols | |
| 2004/0173363 | A1 | 9/2004 | Navarro-Sorroche | |
| 2004/0262011 | A1 | 12/2004 | Huckabee et al. | |
| 2006/0196660 | A1 | 9/2006 | Patel | |
| 2007/0235185 | A1 | 10/2007 | Patel et al. | |
| 2008/0257544 | A1 | 10/2008 | Thigpen et al. | |
| 2009/0188665 | A1 | 7/2009 | Tubel et al. | |
| 2009/0260835 | A1 | 10/2009 | Malone | |
| 2009/0283272 | A1 | 11/2009 | Amaral et al. | |
| 2009/0288824 | A1 | 11/2009 | Fowler, Jr. et al. | |
| 2010/0038093 | A1 | 2/2010 | Patel | |
| 2010/0139909 | A1 | 6/2010 | Tirado et al. | |
| 2010/0175894 | A1 * | 7/2010 | Debard et al. | 166/382 |
| 2010/0193182 | A1 * | 8/2010 | Levy | 166/250.01 |
| 2010/0212963 | A1 | 8/2010 | Gopalan et al. | |
| 2010/0243270 | A1 | 9/2010 | Ingram et al. | |
| 2011/0011577 | A1 | 1/2011 | Dusterhoft et al. | |
| 2011/0024105 | A1 | 2/2011 | Hammer et al. | |
| 2011/0061862 | A1 | 3/2011 | Loretz et al. | |
| 2011/0061875 | A1 | 3/2011 | Tips et al. | |
| 2011/0108287 | A1 * | 5/2011 | Richards | 166/381 |
| 2011/0120726 | A1 | 5/2011 | Murray et al. | |
| 2011/0132601 | A1 | 6/2011 | Pettinato et al. | |
| 2011/0209873 | A1 | 9/2011 | Stout | |
| 2011/0214883 | A1 | 9/2011 | Patel | |
| 2012/0024520 | A1 | 2/2012 | Fripp et al. | |
| 2012/0181043 | A1 | 7/2012 | Patel | |
| 2012/0181045 | A1 | 7/2012 | Thomas et al. | |
| 2012/0199346 | A1 | 8/2012 | Patel et al. | |
| 2012/0222860 | A1 * | 9/2012 | Kalman et al. | 166/270 |
| 2012/0325484 | A1 | 12/2012 | Patel | |

OTHER PUBLICATIONS

Search Report and Written Opinion cited in International Application No. PCT/US2012/057220 dated Apr. 8, 2013.

Search Report and Written Opinion cited in International Application No. PCT/US2012/057257 dated Apr. 23, 2013.

Search Report and Written Opinion cited in International Application No. PCT/US2012/057283 dated Apr. 23, 2013.

Search Report and Written Opinion cited in International Application No. PCT/US2012/057215 dated Apr. 25, 2013.

Search Report and Written Opinion cited in International Application No. PCT/US2012/057241 dated Apr. 29, 2013.

Halliburton Energy Services, Inc., "Sand Control Systems", H06382, company article dated Jul. 2009, 6 pages.

Office Action issued Jun. 19, 2014 in U.S. Appl. No. 13/979,137, 10 pages.

Halliburton Energy Services, Inc. "IV Series Interval Control Valves," H06972 dated Aug. 2009, 2 pages.

Halliburton Energy Services, Inc. "Scrams", H06976, Feb. 2012, 2 pages.

Halliburton Energy Services, Inc. "Long Space-Out Travel Joint (LSOTJ)," H08460, dated Dec. 2011, 2 pages.

Halliburton Brochure entitled "Sand Control Systems, Enhanced Single Trip Multizone (ESMTZ tm) System", H06382, 2009.

Mazerov, "GOM Completions: Innovation Filling in Technology Gaps at Nearly Six Miles Under," reprinted from the May/Jun. 2009 edition of Drilling Contractor Magazine.

Specification and Drawings for U.S. Appl. No. 13/913,111, filed Jun. 7, 2013, 47 pages.

Specification and Drawings for U.S. Appl. No. 13/950,674, filed Jul. 25, 2013, 44 pages.

Office Action issued Oct. 4, 2013 in U.S. Appl. No. 13/913,111, 23 pages.

Office Action issued Oct. 4, 2013 in U.S. Appl. No. 13/918,077, 15 pages.

Office Action issued Dec. 20, 2013 for U.S. Appl. No. 13/950,674, 22 pages.

Office Action issued Feb. 10, 2014 for U.S. Appl. No. 13/913,111, 21 pages.

Specification and Drawings for PCT Patent App. No. PCT/US12/57266, filed Sep. 26, 2012, 42 pages.

Specification and Drawings for PCT Patent App. No. PCT/US12/57271, filed Sep. 26, 2012, 40 pages.

Specification and Drawings for PCT Patent App. No. PCT/US12/57278, filed Sep. 26, 2012, 42 pages.

Specification and Drawings filed Jul. 10, 2013 for U.S. Appl. No. 13/939,163, 60 pages.

Specification and Drawings filed Jul. 10, 2013 for U.S. Appl. No. 13/979,137, 42 pages.

Specification and Drawings filed Sep. 5, 2013 for U.S. Appl. No. 14/003,451, 52 pages.

Search Report and Written Opinion cited in International Appl. No. PCT/US2012/057271 dated Apr. 26, 2013.

Search Report and Written Opinion cited in International Appl. No. PCT/US2012/057278 dated May 8, 2013.

Search Report and Written Opinion cited in International Appl. No. PCT/US2012/057231 dated Apr. 23, 2013.

Office Action issued Apr. 15, 2014 in U.S. Appl. No. 13/913,111, 22 pages.

Office Action issued Apr. 10, 2014 in U.S. Appl. No. 13/918,077, 26 pages.

Office Action issued Mar. 12, 2014 in U.S. Appl. No. 13/950,674, 14 pages.

Office Action issued Apr. 30, 2014 in U.S. Appl. No. 13/988,139, 14 pages.

Office Action issued Apr. 2, 2014 in U.S. Appl. No. 13/896,887, 7 pages.

Office Action issued May 6, 2014 in U.S. Appl. No. 13/988,099, 17 pages.

* cited by examiner

SINGLE TRIP MULTI-ZONE COMPLETION SYSTEMS AND METHODS

CROSS-REFERENCE TO RELATED APPLICATIONS

This application is a continuation of U.S. patent application Ser. No. 13/885,502 filed on May 15, 2013, which claims priority to and is a National Stage entry of International Application No. PCT/US2012/057257 filed on Sep. 26, 2012.

BACKGROUND

The present invention relates to the treatment of subterranean production intervals and, more particularly, to gravel packing, fracturing, and production of multiple production intervals with a single trip multi-zone completion system.

In the production of oil and gas, recently drilled deep wells reach as much as 31,000 feet or more below the ground or subsea surface. Offshore wells may be drilled in water exhibiting depths of as much as 10,000 feet or more. The total depth from an offshore drilling vessel to the bottom of a drilled wellbore can be in excess of six miles. Such extraordinary distances in modern well construction cause significant challenges in equipment, drilling, and servicing operations.

For example, tubular strings can be introduced into a well in a variety of different ways. It may take many days for a wellbore service string to make a "trip" into a wellbore, which may be due in part to the time consuming practice of making and breaking pipe joints to reach the desired depth. Moreover, the time required to assemble and deploy any service tool assembly downhole for such a long distance is very time consuming and costly. Since the cost per hour to operate a drilling or production rig is very expensive, saving time and steps can be hugely beneficial in terms of cost-savings in well service operations. Each trip into the wellbore adds expense and increases the possibility that tools may become lost in the wellbore, thereby requiring still further operations for their retrieval. Moreover, each additional trip into the wellbore oftentimes has the effect of reducing the inner diameter of the wellbore, which restricts the size of tools that are able to be introduced into the wellbore past such points.

To enable the fracturing and/or gravel packing of multiple hydrocarbon-producing zones in reduced timelines, some oil service providers have developed "single trip" multi-zone systems. This single trip multi-zone completion technology enables operators to perforate a large wellbore interval at one time, then make a clean-out trip and run all of the screens and packers at one time, thereby minimizing the number of trips into the wellbore and rig days required to complete conventional fracture and gravel packing operations in multiple pay zones. It is estimated that such technology can save in the realm of $20 million per well in deepwater completions. Since rig costs are so high in the deepwater environment, due to the extreme conditions, more efficient and economical means of carrying out single trip multi-zone completion operations is an ongoing effort.

SUMMARY OF THE INVENTION

The present invention relates to the treatment of subterranean production intervals and, more particularly, to gravel packing, fracturing, and production of multiple production intervals with a single trip multi-zone completion system.

In some embodiments of the disclosure, a single trip multi-zone completion system is disclosed. The system may include an outer completion string having at least one sand screen arranged thereabout and being deployable in an open hole section of a wellbore that penetrates at least one formation zone, a production tubing arranged within the outer completion string and having at least one interval control valve disposed thereon, a control line extending external to the production tubing and being communicably coupled to the at least one interval control valve, and a surveillance line extending external to the outer completion string and interposing the at least one formation zone and the at least one sand screen.

In other embodiments of the disclosure, a single trip multi-zone completion system for producing from one or more formation zones penetrated by a wellbore may be disclosed. The system may include an outer completion string having at least one sand screen disposed thereabout adjacent the one or more formation zones within an open hole section of the wellbore, a production tubing extending within the outer completion string and being communicably coupled thereto at a crossover coupling, the crossover coupling having one or more control lines coupled thereto, at least one interval control valve disposed on the production tubing and being communicably coupled to the one or more control lines, and a surveillance line extending external to the outer completion string and interposing the one or more formation zones and the at least one sand screen, the surveillance line being communicably coupled to the one or more control lines at the crossover coupling.

In yet other embodiments, a method of producing from one or more formation zones is disclosed. The method may include arranging an outer completion string within an open hole section of a wellbore adjacent the one or more formation zones, the outer completion string having at least one sand screen disposed thereabout, extending a production tubing within the outer completion string, the production tubing having at least one interval control valve disposed thereon, communicably coupling the production tubing to the completion string at a crossover coupling having one or more control lines coupled thereto, actuating the at least one interval control valve to initiate production into the production tubing at the at least one interval control valve, the at least one interval control valve being communicably coupled to the one or more control lines, and measuring one or more fluid and/or well environmental parameters external to the outer completion string with a surveillance line communicably coupled to the one or more control lines at the crossover coupling and being arranged between the one or more formation zones and the at least one sand screen.

In other embodiments, a method of deploying a single trip multi-zone completion system is disclosed. The method may include locating an inner service tool within an outer completion string arranged within an open hole section of a wellbore that penetrates one or more formation zones, the outer completion string having at least one sand screen arranged thereabout, treating the one or more formation zones with the inner service tool, wherein a surveillance line extends external to the outer completion string and interposes the one or more formation zones and the at least one sand screen, retrieving the inner service tool from within the outer completion string, extending a production tubing within the outer completion string and communicably coupling the production tubing to the completion string at a crossover coupling where one or more control lines are extended, the surveillance line extending from the one or more control lines, and actuating the at least one interval control valve to initiate a fluid flow into the production tubing at the at least one interval control valve, the at least one interval control valve being communicably coupled to the one or more control lines.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to the treatment of subterranean production intervals and, more particularly, to gravel packing, fracturing, and production of multiple production intervals with a single trip multi-zone completion system.

The exemplary single trip multi-zone systems and methods disclosed herein allow multiple zones of a wellbore to be gravel packed and fractured in the same run-in trip into the wellbore. An outer completion string may be lowered into the wellbore and used to hydraulically fracture and gravel pack the multiple zones. An exemplary production tubing having one or more interval control valves and associated control modules arranged thereon is subsequently extended into the wellbore and stung into the outer completion string in order to regulate and monitor production from each production interval. Dual control lines located along the outer surface of the production tubing and also along the sand face pack allow operators to monitor production operations, including measuring fluid and well environment parameters at each point within the system.

Adjusting the position of a flow control device associated with each interval control valve serves to choke or otherwise regulate the production flow rate through associated sand screens, thereby allowing for the intelligent production of hydrocarbons from each production interval or formation zone. In the event an interval control valve or associated control module fails or is otherwise rendered inoperative, the production tubing may be returned to the surface without requiring the removal of the outer completion string or the remaining portions of the gravel pack and system. Once proper repairs or modifications have been completed, the production tubing may once again be run into the wellbore to resume production.

Figure 1:
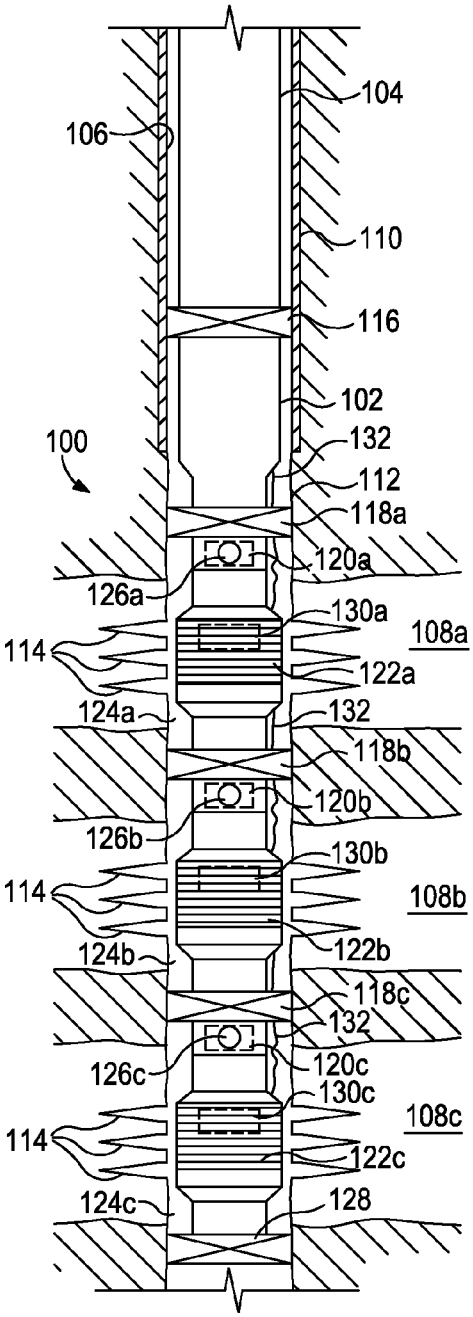
FIG. 1 is an exemplary single trip multi-zone completion system, according to one or more embodiments.

Referring to FIG. 1, illustrated is an exemplary single trip multi-zone completion system 100, according to one or more embodiments. As illustrated, the system 100 may include an outer completion string 102 that may be coupled to a work string 104 configured to extend longitudinally within a wellbore 106. The wellbore 106 may penetrate multiple subterranean formation zones 108*a*, 108*b*, and 108*c*, and the outer completion string 102 may be extended into the wellbore 106 until being arranged or otherwise disposed generally adjacent the formation zones 108*a-c*. The formation zones 108*a-c* may be portions of a common subterranean formation or hydrocarbon-bearing reservoir. Alternatively, one or more of the formation zones 108*a-c* may be portion(s) of separate subterranean formations or hydrocarbon-bearing reservoirs. The term "zone" as used herein, however, is not limited to one type of rock formation or type, but may include several types, without departing from the scope of the disclosure.

As will be discussed in greater detail below, the outer completion string 102 may be deployed within the wellbore 106 in a single trip and used to hydraulically fracture ("frack") and gravel pack the various formation zones 108*a-c*, and subsequently intelligently regulate hydrocarbon production from each production interval or formation zone 108*a-c*. Although only three formation zones 108*a-c* are depicted in FIG. 1, it will be appreciated that any number of formation zones 108*a-c* (including one) may be treated or otherwise serviced using the system 100, without departing from the scope of the disclosure.

As depicted in FIG. 1, portions of the wellbore 106 may be lined with a string of casing 110 and properly cemented therein, as known in the art. The remaining portions of the wellbore 106, including the portions encompassing the formation zones 108*a-c*, may be an open hole section 112 of the wellbore 106 and the outer completion string 102 may be configured to be generally arranged therein during operation. As will be discussed in more detail below, several fractures 114 may be initiated at or in each formation zone 108*a-c* and configured to provide fluid communication between each respective formation zone 108*a-c* and the annulus formed between the outer completion string 102 and walls of the open hole section 112. Particularly, a first annulus 124*a* may be generally defined between the first formation zone 108*a* and the outer completion string 102. Second and third annuli 124*b* and 124*c* may similarly be defined between the second and third formation zones 108*b* and 108*c*, respectively, and the outer completion string 102.

The outer completion string 102 may have a top packer 116 including slips (not shown) configured to support the outer completion string 102 within the casing 110 when properly deployed. In some embodiments, the top packer 116 may be a VERSA-TRIEVE® hangar packer commercially available from Halliburton Energy Services of Houston, Tex., USA. Disposed below the top packer 116 may be one or more isolation packers 118 (three shown), one or more circulating sleeves 120 (three shown in dashed), and one or more sand screens 122 (three shown). Specifically, arranged below the top packer 116 may be first isolation packer 118*a*, a first circulating sleeve 120*a* (shown in dashed), and a first sand screen 122*a*. A second isolation packer 118*b* may be disposed below the first sand screen 122*a*, and a second circulating sleeve 120*b* (shown in dashed) and a second sand screen 122*b* may be disposed below the second isolation packer 118*b*. A third isolation packer 118*c* may be disposed below the second sand screen 122*b*, and a third circulating sleeve 120*c* (shown in dashed) and a third sand screen 122*c* may be disposed below the third isolation packer 118*c*.

Each circulating sleeve 120*a-c* may be movably arranged within the outer completion string 102 and configured to axially translate between open and closed positions. Although described herein as movable sleeves, those skilled in the art will readily recognize that each circulating sleeve 120*a-c* may be any type of flow control device known to those skilled in the art, without departing from the scope of the disclosure. First, second, and third ports 126*a*, 126*b*, and 126*c* may be defined in the outer completion string 102 at the first, second, and third circulating sleeves 120*a-c*, respectively. When the circulating sleeves 120*a-c* are moved into their respective open positions, the ports 126*a-c* are opened or otherwise incrementally exposed and may thereafter provide fluid communication between the interior of the outer completion string 102 and the corresponding annuli 124*a-c*.

Each sand screen 122*a-c* may include a corresponding flow control device 130*a*, 130*b*, and 130*c* (shown in dashed) movably arranged therein and also configured to axially translate between open and closed positions. In some embodiments, each flow control device 130*a-c* may be characterized as a sleeve, such as a sliding sleeve that is axially translatable within its associated sand screen 122*a-c*. As will be discussed in greater detail below, each flow control device 130*a-c* may be moved or otherwise manipulated in order to facilitate fluid communication between the formation zones 108*a-c* and the outer completion string 102 via its corresponding sand screen 122*a-c*.

In order to deploy the outer completion string 102 within the open hole section 112 of the wellbore 106, it is first assembled at the surface starting from the bottom up until it is completely assembled and suspended in the wellbore 106 up to a packer or slips arranged at the surface. The outer completion string 102 may then be lowered into the wellbore 102 on the work string 104, which is generally made up to the top packer 120. Upon attaching appropriate setting tools to the upper ends of the outer completion string 102, the entire assembly may be lowered into the wellbore 106 on the work string 104.

Upon properly aligning the sand screens 122*a-c* with the corresponding production zones 108*a-c*, the top packer 116 may be set within the casing 110, thereby anchoring or otherwise suspending the outer completion string 102 within the open hole section 112 of the wellbore 106. The isolation packers 118*a-c* and a bottom packer 128 may also be set at this time, thereby defining individual production intervals corresponding to the various formation zones 108*a-c*. As illustrated, the bottom packer 128 may be set within the wellbore 106 below the third formation zone 108*c* and the third sand screen 122*c*. The bottom packer 128 may be, for example, an open hole packer that acts as a sump packer, as generally known in the art. The work string 104 may then be detached from the top packer 116 and removed from the well, along with any accompanying setting tools and/or devices.

At this point, an inner service tool (not shown), also known as a gravel pack service tool, may be assembled and lowered into the outer completion string 102 on a work string (not shown) made up of drill pipe or tubing. The inner service tool is positioned in the first zone to be treated, e.g., the third production interval or formation zone 108*c*. The inner service tool may include one or more shifting tools (not shown) used to open and/or close the circulating sleeves 120*a-c* and the flow control devices 130*a-c*. In some embodiments, for example, the inner service tool has two shifting tools arranged thereon or otherwise associated therewith; one shifting tool configured to open the circulating sleeves 120*a-c* and the flow control devices 130*a-c*, and a second shifting tool configured to close the circulating sleeves 120*a-c* and flow control devices 130*a-c*. In other embodiments, more or less than two shifting tools may be used, without departing from the scope of the disclosure. In yet other embodiments, the shifting tools may be omitted entirely from the inner service tool and instead the circulating sleeves 120*a-c* and flow control devices 130*a-c* may be remotely actuated, such as by using actuators, solenoids, pistons, and the like.

Before producing hydrocarbons from the various formation zones 108*a-c* penetrated by the outer completion string 102, each formation zone 108*a-c* may be hydraulically fractured in order to enhance hydrocarbon production, and each annulus 124*a-c* may be gravel packed to ensure limited sand production into the outer completion string 102 during production. The fracturing and gravel packing processes for the outer completion string 102 may be accomplished sequentially or otherwise in step-wise fashion for each individual formation zone 108*a-c*, starting from the bottom of the outer completion string 102 and proceeding in an uphole direction (i.e., toward the surface of the well). In one embodiment, for example, the third production interval or formation zone 108*c* may be fractured and the third annulus 124*c* may be gravel packed prior to proceeding to the second and first formation zones 108*b* and 108*a*, in sequence. The third annulus 124*c* may be defined generally between the bottom packer 128 and the third isolation packer 118*c*. The one or more shifting tools may be used to open the third circulating sleeve 120*c* and the third flow control device 130*c* disposed within the third sand screen 122*c*. In other embodiments, however, the third circulation sleeve 120*c* and flow control device 130*c* may have already been opened either at the surface or at another point during the deployment process in the wellbore 106.

A fracturing fluid may then be pumped down the work string and into the inner service tool. In some embodiments, the fracturing fluid may include a base fluid, a viscosifying agent, proppant particulates (including a gravel slurry), and one or more additives, as generally known in the art. The incoming fracturing fluid may be directed out of the outer completion string 102 and into the third annulus 124*c* via the third port 126*c*. Continued pumping of the fracturing fluid forces the fracturing fluid into the third formation zone 108*c*, thereby creating or enhancing the fractures 114 and extending a fracture network into the third formation zone 108*c*. The accompanying proppant serves to support the fracture network in an open configuration. The incoming gravel slurry builds in the annulus 124*c* between the bottom packer 128 and the third isolation packer 118*c* and the particulates therein begin to form what is referred to as an "sand face" pack. The sand face pack, in conjunction with the third sand screen 122*c*, serves to prevent the influx of sand or other particulates from the third formation zone 108*c* into the outer completion string 102 during production operations.

Once a desired net pressure is built up in the third formation zone 108*c*, the fracturing fluid injection rate is stopped. The inner service tool is then axially moved to position in the reverse position and a return flow of fracturing fluid flows through the work string 104 in order to reverse out any excess proppant that may remain in the work string 104. When the proppant is successfully reversed, the third circulating sleeve 120*c* and the third flow control device 130*c* are closed using the one or more shifting tools, and the third annulus 124*c* is then pressure tested to verify that the corresponding circulating sleeve 120*c* and flow control device 130*c* are properly closed. At this point, the third formation zone 108*c* has been successfully fractured and the third annulus 124*c* has been gravel packed.

The inner service tool (i.e., gravel pack service tool) may then be axially moved within the outer completion string 102 to locate the second formation zone 108*b* and the first formation zone 108*a*, successively, where the foregoing process is repeated in order to fracture the first and second formation zones 108*a,b* and gravel pack the first and second annuli 124*a,b*. The second annulus 124*b* may be generally defined axially between the second and third isolation packers 118*b, c*. Upon locating the second production interval or formation zone 108*b*, the one or more shifting tools may be used to open the second circulating sleeve 120*b* and the second flow control device 130*b*. Again, the second circulating sleeve 120*b* and flow control device 130*b* may have been opened prior to this point or at any other point during the deployment process, without departing from the scope of the disclosure. Fracturing fluid may then be pumped into the second annulus 124*b* via the second port 126*b*. The injected fracturing fluid fractures the second formation zone 108*b*, and the gravel slurry adds to the sand face pack in the second annulus 124*b* between the second isolation packer 118*b* and the third isolation packer 118*c*.

Once the second annulus 124*b* is pressure tested, the inner service tool may then be axially moved to locate the first formation zone 108*a* and again repeat the foregoing process. The first annulus 124*a* may be generally defined between the first and second isolation packers 118*a,b*. Upon locating the first production interval or formation zone 108*a*, the one or more shifting tools may be used to open the first circulating sleeve 120*a* and flow control device 130*a* (or they may be opened remotely, as described above), and fracturing fluid is pumped into the first annulus 124*a* via the first port 126*a*. The injected fracturing fluid creates or enhances fractures in the first formation zone 108*a*, and the gravel slurry adds to the sand face pack in the first annulus 124*a* between the first and second isolation packers 118*a,b*. Once the first annulus 124*a* is pressure tested, the inner service tool may be removed from the outer completion string 102 and the well altogether, with the circulation sleeves 120*a-c* and flow control devices 130*a-c* being closed and providing isolation during installation of the remainder of the completion, as discussed below.

Still referring to FIG. 1, the system 100 may further include a surveillance line 132 extending externally along the outer completion string 102 and within the sand face or gravel pack of each annulus 124*a-c* in each formation zone 108*a-c*. As will be described in greater detail below, the surveillance line 132 may include one or more control lines that extend from a crossover coupling (not shown in FIG. 1) arranged within the outer completion string 102. The isolation packers 118*a-c* may include or otherwise be configured for control line bypass which allows the surveillance line 132 to pass therethrough external to the outer completion string 102.

The surveillance line 132 may be representative of or otherwise include one or more electrical lines and/or one or more fiber optic lines communicably coupled to various sensors and gauges arranged along the sand face pack and within each gravel packed annuli 124*a-c*. The surveillance line 132 may include, for example, a fiber optic line and one or more accompanying fiber optic gauges or sensors (not shown). The fiber optic line may be deployed along the sand face pack and the associated gauges/sensors may be configured to measure and report various fluid properties and well environment parameters within each gravel packed annulus 124*a-c*. For instance, the fiber optic line may be configured to measure pressure, temperature, fluid density, vibration, seismic waves (e.g., flow-induced vibrations), water cut, flow rate, combinations thereof, and the like within the sand face pack. In some embodiments, the fiber optic line may be configured to measure temperature along the entire axial length of each sand screen 122*a-c*, such as through the use of various fiber optic distributed temperature sensors or single point sensors arranged along the sand face pack, and otherwise measure fluid pressure in discrete or predetermined locations within the sand face pack.

The surveillance line 132 may further include an electrical line coupled to one or more electric pressure and temperature gauges/sensors situated along the outside of the outer completion string 102. Such gauges/sensors may be arranged adjacent to each sand screen 122*a-c*, for example, in discrete locations on one or more gauge mandrels (not shown). In operation, the electrical line may be configured to measure fluid properties and well environment parameters within each gravel packed annulus 124*a-c*. Such fluid properties and well environment parameters include, but are not limited to, pressure, temperature, fluid density, vibration, seismic waves (e.g., flow-induced vibrations), water cut, flow rate, combinations thereof, and the like. In some embodiments, the electronic gauges/sensors can be ported to the inner diameter of each sand screen 122*a-c* and thereby provide pressure drop readings through the sand screens 122*a-c*.

Accordingly, the fiber optic and electrical lines of the surveillance line 132 may provide an operator with two sets of monitoring data for the same or similar location within the sand face pack or production intervals. In operation, the electric and fiber optical gauges may be redundant until one technology fails or otherwise malfunctions. As will be appreciated by those skilled in the art, using both types of instrumenting methods provides a more robust monitoring system against failures. Moreover, this redundancy may aid in accurately diagnosing problems with the wellbore equipment, such as the flow control devices 130*a-c*.

Figure 2:
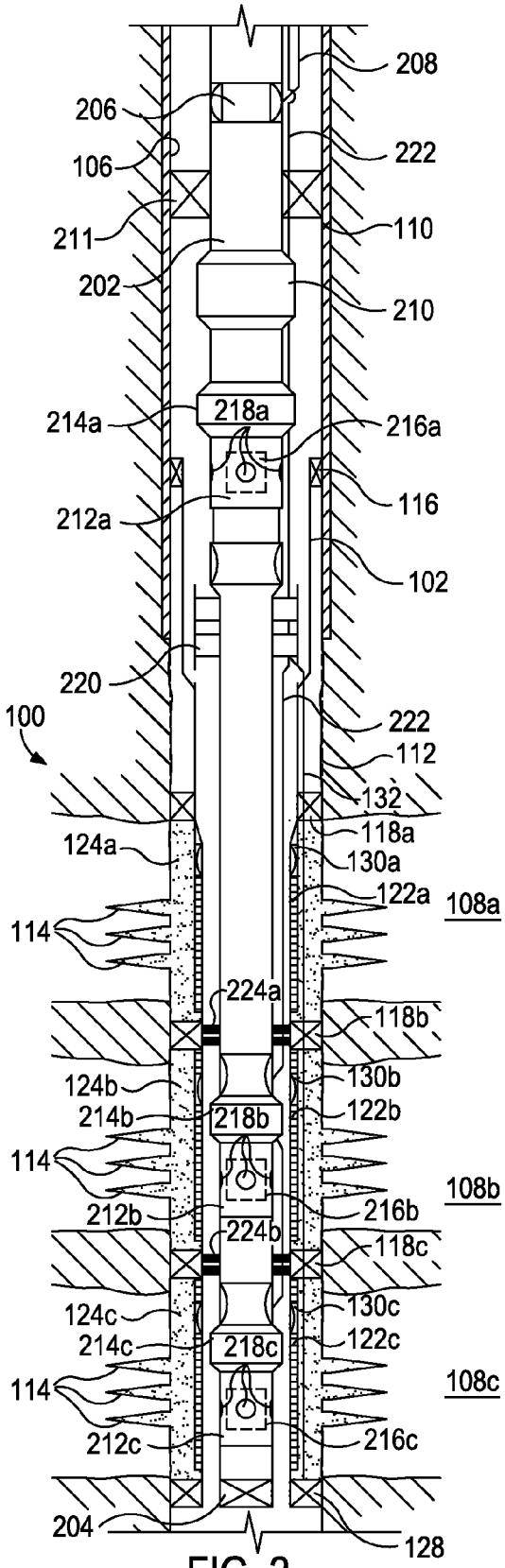
FIG. 2 is a partial cross-sectional view of the single trip multi-zone completion system of FIG. 1, having an exemplary production string arranged therein, according to one or more embodiments disclosed

Referring now to FIG. 2, with continued reference to FIG. 1, illustrated is a partial cross-sectional view of the single trip multi-zone completion system 100 with an exemplary production tubing 202 arranged therein, according to one or more embodiments. The production tubing 202 may be run into the wellbore 106 and extended into the outer completion string 102 until engaging or otherwise being arranged substantially adjacent the bottom packer 128. In some embodiments, the production tubing 202 may be stung into the bottom packer 128 and thereby secured thereto. The bottom of the production tubing 202 may be blanked off, in at least one embodiment, with a wireline plug in nipple 204. The nipple 204 may or may not be used depending on the condition of the bottom packer 128 (i.e., sump packer) or the area therebelow. For instance, if the bottom packer 128 is able to adequately hold, then the nipple 204 may be omitted.

In some embodiments, as the production tubing 202 is lowered into the outer completion string 102, each flow control device 130*a-c* may be moved into the open position. This may be accomplished, in at least one embodiment, using one or more shifting tools (not shown) arranged on the production tubing 202 and configured to locate and move each flow control device 130*a-c*. In other embodiments, however, the shifting tool(s) may be omitted and instead the flow control devices 130*a-c* may be configured to be remotely opened. For instance, the flow control devices 130*a-c* may be in communication (either wired or wirelessly) with an operator or another downhole tool such that the flow control devices 130*a-c* may be moved between open and closed positions when desired.

The production tubing 202 may include a safety valve 206 arranged in or otherwise forming part of the production tubing 202. In some embodiments, the safety valve 206 may be a tubing-retrievable safety valve, such as the DEPTHSTAR® safety valve commercially-available from Halliburton Energy Services of Houston, Tex., USA. The safety valve 206 may be controlled using a first control line 208 that extends to the safety valve 206 from a remote location, such as the Earth's surface or another location within the wellbore 106. In at least one embodiment, the control line 208 may be a surface-controlled subsurface safety valve control line configured to control the actuation or operation of the safety valve 206.

The production tubing 202 may also include a travel joint 210 arranged in or otherwise forming part of the production tubing 202. In operation, the travel joint 210 may be configured to expand and/or contract axially, thereby effectively lengthening and/or contracting the axial length of the production tubing 202 such that a well head tubing hanger may be accurately attached at the top of the production tubing 102 string and landed inside of the well head. The travel joint 210 may be actuated or powered either electrically, hydraulically, or with tubing compression, as known in the art.

In other embodiments, however, the travel joint 210 may be omitted from the system 100 and instead may include one or more wellbore locating mechanisms (not shown), such as a series of e-line indicators, radio frequency identification tags, radioactive tags, or the like. Such wellbore locating mechanisms may be strategically arranged along the wellbore 106 and/or the production tubing 202 and configured to communicate with each other, the surface, or one or more other downhole tools in order to accurately position the production tubing 202 within the outer completion string 102.

The production tubing 202 is lowered into the well until a crossover coupling 220 is landed inside the outer completion string 102. As a result, vital portions of the production tubing 202 may be strategically aligned with the formation zones 108*a-c*, thereby facilitating the production of hydrocarbons therefrom. Once the production tubing 202 is located and anchored at crossover coupling 220 and the well head attached, an upper packer 211 may be set within the casing string 110, thereby anchoring the production tubing 202 within the wellbore 106. In some embodiments, the upper packer 116 may be a retrievable packer, such as an HF-1 packer commercially available from Halliburton Energy Services of Houston, Tex., USA.

To facilitate the production of hydrocarbons from the formation zones 108*a-c*, the production tubing 202 may further include one or more interval control valves 212 and one or more associated control modules 214 communicably coupled to the interval control valves 212. In some embodiments, however, one or more of the interval control valves 212 may be replaced with such flow control devices as, but not limited to, an inflow control device, an adjustable inflow control device, an autonomous variable flow restrictor, a production sleeve, or the like, without departing from the scope of the disclosure.

As illustrated, a first interval control valve 212*a* may be arranged in the production tubing 202 and associated with a first control module 214*a*, a second interval control valve 212*b* may be axially spaced from the first interval control valve 212*a* along the production tubing 202 and associated with a second control module 214*b*, and a third interval control valve 212*b* may be axially spaced from the second interval control valve 212*b* along the production tubing 202 and associated with a third control module 214*c*. Each interval control valve 212*a-c* and corresponding control module 214*a-c* may be associated with a particular formation zone 108*a-c* and otherwise configured to intelligently regulate hydrocarbon production therefrom. For instance, the first interval control valve 212*a* and corresponding first control module 214*a* may be associated with the first formation zone 108*a*, the second interval control valve 212*b* and corresponding second control module 214*b* may be associated with the second formation zone 108*b*, and the third interval control valve 212*c* and corresponding third control module 214*c* may be associated with the third formation zone 108*a*.

Each interval control valve 212*a-c* may include a corresponding variable choke sleeve 216*a*, 216*b*, and 216*c* (shown in dashed) movably arranged therein and configured to axially translate between open and closed positions. Although generally described herein as a movable sleeve, one or more of the variable choke sleeves 216*a-c* may be any type of flow control device known to those skilled in the art. For instance, one or more of the variable choke sleeves 216*a-c* may be production sleeves, inflow control devices, autonomous valves, etc., without departing from the scope of the disclosure. When in the closed position, the variable choke sleeve 216*a-c* substantially occludes a corresponding one or more flow ports 218*a*, 218*b*, and 218*c* defined in each control valve 212*a-c*, thereby preventing fluid flow into the production tubing 202. Each variable choke sleeve 216*a-c*, however, may be incrementally moved until at least a portion of the one or more flow ports 218*a-c* is exposed and thereby allows fluid flow into the interior of the production tubing 202 from the associated formation zone 108*a-c*.

In one or more embodiments, each control module 214*a-c* may include an actuator, solenoid, piston, or similar actuating device (not shown) coupled to the associated variable choke sleeve 216*a-c* and configured to incrementally manipulate the axial position of the variable choke sleeve 216*a-c*. One or more position sensors (not shown) may also be included in or otherwise associated with each control module 214*a-c* and configured to measure and report the axial position of each variable choke sleeve 216*a-c* as moved within with the interval control valves 212*a-c*. Accordingly, the position of each variable choke sleeve 216*a-c* may be known and adjusted in real-time in order to choke or otherwise regulate the production flow rate through each corresponding interval control valve 212*a-c*. In some embodiments, for example, it may be desired to open one or more of the variable choke sleeves 216*a-c* only partially (e.g., 20%, 40%, 60%, etc.) in order to choke production flow from one or more associated formation zones 108*a-c*. In other embodiments, it may be desired to slow or entirely shut down production from a particular production interval or formation zone 108*a-c* and instead produce increased amounts from the remaining production intervals or formation zones 108*a-c*.

In some embodiments, one or more of the flow ports 218*a-c* may have an elongated or progressively enlarged shape in the axial direction. As a result, as the corresponding variable choke sleeve 216*a-c* translates to its open position, the volumetric flow rate through the port 218*a-c* may progressively increase proportional to its progressively enlarged shape. In some embodiments, for example, one or more of the ports 218*a-c* may exhibit an elongated triangular shape which progressively increases volumetric flow potential in the axial direction, thereby allowing an increased amount of fluid flow as the corresponding variable choke sleeve 216*a-c* moves to its open position. In other embodiments, however, one or more of the ports 218*a-c* may exhibit a tear drop shape or the like, and achieve substantially the same fluid flow increase as the variable choke sleeve 216*a-c* moves axially. Accordingly, each control valve 212*a-c* may be characterized as an integrated flow control choke device.

Moreover, the control modules 214*a-c* may further include one or more sensors or gauges (not shown) configured to measure and report real-time pressure, temperature, and flow rate data for each associated formation zone 108*a-c*. The data feedback and accurate flow control capability of each interval control valve 212*a-c* as controlled by the associated control modules 214*a-c* allows an operator to optimize reservoir performance and enhance reservoir management. In one or more embodiments, one or more of the control modules 214*a-c* may be a SCRAMS® (Surface Controlled Reservoir Analysis and Management System) device commercially available through Halliburton Energy Services of Houston, Tex., USA. At least one advantage of using the SCRAMS® technology is the incorporation of redundant electrical and hydraulic control lines that ensure uninterrupted control of the interval control valves 212*a-c* even in the event the main electrical and/or hydraulic control lines feeding the particular control module 214*a-c* are severed or otherwise rendered inoperable.

Those skilled in the art will readily recognize, however, that the control modules 214*a-c* may be any other known downhole tool configured to regulate fluid flow through an interval control valve 212*a-c* or similar downhole flow control device.

As briefly mentioned above, the production tubing 202 may be stung into or otherwise communicably coupled to the outer completion string 102 at the crossover coupling 220. In some embodiments, the crossover coupling 220 may be an electro-hydraulic wet connect that provides an electrical and/or fiber optic wet mate connection between opposing male and female connectors. In other embodiments, the crossover coupling 220 may be an inductive coupler providing an electromagnetic coupling or connection with no contact between the crossover coupling and the internal tubing. In some embodiments, as illustrated, the crossover coupling 220 may be arranged within the wellbore 106 below or otherwise downhole from the top packer 116. Exemplary crossover couplings 220 that may be used in the disclosed system 100 are described in U.S. Pat. Nos. 8,082,998 and 8,079,419, 4,806,928 and in U.S. Pat. Pub. No. 2012/0181045, each of which is hereby incorporated by reference in their entirety.

A second control line 222 may extend to the crossover coupling 220 external to the production tubing 202 from a remote location (e.g., the surface or another location within the wellbore 106). In some embodiments, the second control line 222 may be a flatpack control umbilical, or the like, and may be representative of or otherwise include one or more hydraulic lines, one or more electrical lines, and/or one or more fiber optic lines. The hydraulic and electrical lines may be configured to provide hydraulic and electrical power to various downhole equipment, such as the travel joint 210 and the control modules 214*a-c*. In some embodiments, the electrical lines may also be configured to receive and convey command signals and otherwise transmit data to and from the surface of the well. The electrical and fiber optic lines may be communicably coupled to various sensors and/or gauges arranged along the outer completion string 202, such as the control modules 214*a-c*, and configured to facilitate the monitoring of one or more fluid and/or well environment parameters, such as pressure, temperature, etc.

As illustrated, the second control line 222 may extend to the travel joint 210 and provide hydraulic and/or electrical power thereto. As a result, the travel joint 210 may be able to axially expand and contract and its position or degree of expansion/contraction may be measured and reported to the surface. The second control line 222 may also extend to each control module 214*a-c* and provide hydraulic, electrical, and/or fiber optic control lines thereto. The hydraulic and/or electrical control lines provide power to the actuators, solenoids, or pistons used to incrementally move the variable choke sleeves 216*a-c* between open and closed configurations. The electrical control lines provide the transmission of electric power and communication signals from the surface to the control modules 214*a-c*. The fiber optic and/or electrical control lines facilitate the transmission of sensor or gauge measurements obtained in the wellbore 106 at each control module 214*a-c*. The incoming second control line 222 into the first control module 214 exits thereafter and extends to the second and third control modules 214*b,c,* successively, to provide communication thereto further down the outer completion string 202.

At the crossover coupling 220 a portion of the second control line 222 may be separated therefrom and penetrate the outer completion string 102, thereby providing the surveillance line 132, as generally described above. Upon properly coupling the production tubing 202 to the outer completion string 102 at the crossover coupling 220, the crossover coupling 220 may be configured to provide either an electro-hydraulic wet mate connection or an electromagnetic connection between the surveillance line 132 and the second control line 222. As a result, the second control line 222 may be communicably coupled to the surveillance line 132 such that the second control line 222 is, in effect, extended into the sand face pack of each gravel packed annulus 124*a-c* in the form of the surveillance line 132. Accordingly, the surveillance line 132 may be provided with the electrical and/or fiber optic transmission capabilities that facilitate real time monitoring and reporting of fluid and/or well environment parameters, as generally discussed above.

The production tubing 202 may further include one or more seals 224 (two shown as 224*a* and 224*b*) arranged between the production tubing 202 and the outer completion string 102. In at least one embodiment, the seals 224*a-b* may be configured to stabilize the production tubing 202 within the outer completion string 102 and provide a control line bypass such that the second control line 222 is able to pass (bypass) therethrough as it extends downhole along the production tubing 202.

The seals 224*a-b* may also provide a fluid seal between the production tubing 202 and the outer completion string 102, thereby isolating or otherwise defining the production interval of each associated formation zone 108*a-c*. For example, the first seal 224*a* may be generally arranged within the wellbore 106 axially below the first sand screen 122*a* and the first formation zone 108*a*. Accordingly, during production, fluids entering the interior of the outer completion string 102 through the first sand screen 122*a* are prevented from escaping into lower portions of the outer completion string 102. Instead, the incoming fluids are forced into the production tubing 202 via the first interval control valve 212*a* and associated flow ports 218*a*. The upper packer 211 also provides a fluid seal between the casing string 110 and the production tubing 202, thereby preventing fluids from escaping into upper portions of the wellbore 106 past the upper packer 211.

The second seal 224*b* may be generally arranged within the wellbore 106 axially below the second sand screen 122*b* and the second formation zone 108*b*, but axially above the third sand screen 122*c* and the third formation zone 108*c*. Accordingly, fluids entering the interior of the outer completion string 102 via the second sand screen 122*b* are prevented from escaping into lower portions of the outer completion string 102 but are instead forced into the production tubing 202 via the second interval control valve 212*b* and associated flow ports 218*b*. The first seal 224*a* prevents the incoming fluids from escaping into the first production interval.

Fluids entering the outer completion string 102 through the third sand screen 122*c* are bounded on each end by the bottom packer 128 and the second seal 224*b*. Accordingly, incoming fluids into the third production interval are directed into the production tubing 202 via the third interval control valve 212*c* and associated flow ports 218*c*.

The seals 224*a,b* may be characterized as tubing to packer seals and, in at least one embodiment, generally arranged radially inward from at least one of the isolation packers 118*a-c*. In some embodiments, additional seals (not shown) may be included in the system 100 and configured to provide upper and lower fluid boundaries for one or more of the production intervals or formation zone 108*a-c*. For example, an additional seal (similar to the seals 224*a,b*) may be arranged just below the first seal 224*a*, such that the additional seal and the second seal 224*b* provide upper and lower sealed boundaries, respectively, for the second production interval or second formation zone 108*b*. In another embodiment, an additional seal may be arranged adjacent to or otherwise radially inward from the bottom packer 128, such that the second seal 224*b* and the additional seal provide upper and lower sealed boundaries, respectively, for the third production interval or third formation zone 108*c*.

Those skilled in the art will readily appreciate the several advantages afforded by the various embodiments of the disclosed system 100. For example, the sensing and production control capabilities provided by the second control line 222 as extended within the outer completion string 102 may work in conjunction with the sensing capabilities provided by the surveillance line 132 as extended outside the outer completion string 102 and along the sand face pack. In some embodiments, for example, the various sensors/gauges associated with the second control line 222 and the various sensors/gauges associated with the surveillance line 132 may be configured to monitor pressure and temperature differentials between the sand face pack and the interior of the production tubing 202. Such data may allow an operator to determine areas along the wellbore 106 where collapse or water break through has occurred, or when a formation zone 108*a-c* may be nearing zonal depletion. Moreover, pressure drops may be measured and reported through the gravel pack of each annulus 124*a-c*, through the filtration of each sand screen 122*a-c*, and/or via the flow path through the sand screens 122*a-c* to the respective flow control device 130*a-c*.

In other embodiments, one or more of the interval control devices 212*a-c* may be shut off and the sensors and gauges associated therewith and within the sand face pack may be able to determine whether the seals 224*a,b* and/or isolation packers 118*a-c* are leaking or otherwise providing a fluid tight seal. If a leak is detected, diagnostics can be run to determine exactly where the leak is occurring.

In yet other embodiments, a particular flow path for hydrocarbons from the formation zones 108*a-c* into the production tubing 202 may be determined. For example, a particular interval control valve 212*a-c* may be choked down so that a small flow rate is achieved. Re-opening the interval control valve 212*a-c* may allow an operator to determine what path the production is taking through the sand screens 122*a-c*, for example. This is accomplished by monitoring and reporting the pressures external and internal to the outer completion string 102. In some applications, this may be beneficial in detecting water breakthrough.

As will be appreciated, such measurements may prove highly advantageous in intelligently producing the hydrocarbons from each formation zone 108*a-c*. For instance, by knowing real time production rates and other environmental parameters associated with each formation zone 108*a-c*, an operator may be able to adjust fluid flow rates through each sand screen 122*a-c* by incrementally adjusting the interval control valves 212*a-c*. As a result, the formation zones 108*a-c* may be more efficiently produced, in order to maximize production and save time and costs. Moreover, by continually monitoring the environmental parameters of each formation zone 108*a-c*, the operator may be able to determine when a problem has resulted, such as formation collapse, water break through, or zonal depletion, thereby being able to proactively manage production.

Another significant advantage provided by the system 100 is the ability to disconnect the production tubing 202 from the outer completion string 102 and retrieve it to the surface without having to remove the outer completion string 102 from the wellbore 102. For instance, in the event a portion of the production tubing 202 fails, such as an interval control valve 212*a-c* or a control module 214*a-c*, the production tubing 202 may be pulled back to the surface where the failed or faulty devices may be rebuilt, replaced, or upgraded. In some cases, the problems associated with the production tubing 202 may be investigated such that improvements to the production tubing 202 may be undertaken. The repaired or upgraded production tubing 202 may then be reintroduced into the wellbore 106 and communicably coupled once again to outer completion string 102 at the crossover coupling 220, as generally described above.

Various alternative configurations to the single trip multizone completion system 100 are contemplated herein, without departing from the scope of the disclosure. For instance, in some embodiments, the interval control valves 212*a-c* may be replaced with inflow control devices, inflow control devices that can be shut off, or adjustable inflow control devices. This may prove advantageous in applications were an injection well is desired. Such inflow control devices are known to those skilled in the art, and therefore are not described herein.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method of producing from one or more formation zones, comprising:

arranging an outer completion string within an open hole section of a wellbore adjacent the one or more formation zones, the outer completion string having at least one sand screen disposed thereabout and a surveillance line arranged between the one or more formation zones and the at least one sand screen, wherein the surveillance line extends externally along the outer completion string;

extending a production tubing within the outer completion string, the production tubing having at least one interval control valve, a control module associated with the at least one interval control valve, and a control line coupled to the control module, wherein the control line extends externally along the production tubing, and wherein the control line is arranged between the at least one sand screen and the production tubing;

communicably coupling the production tubing to the completion string at a crossover coupling having one or more control lines coupled thereto, the one or more control lines being in communication with the control module and communicably coupled to the surveillance line upon coupling the production tubing to the completion string;

actuating the at least one interval control valve with the control module to initiate production into the production tubing at the at least one interval control valve;

measuring one or more fluid and/or well environmental parameters external to the outer completion string with the surveillance line; and measuring the one or more fluid and/or well environmental parameters within the outer completion string with the control module.

2. The method of claim 1, further comprising opening a flow control device arranged within the at least one sand screen in order to facilitate fluid flow through the at least one sand screen from the one or more formation zones.

3. The method of claim 1, further comprising choking a fluid flow into the production tubing with the at least one interval control valve.

4. The method of claim 1, wherein actuating the at least one interval control valve with the control module further comprises moving a flow control device arranged within the at least one interval control valve between a closed position and an open position with the control module.

5. The method of claim 4, wherein the flow control device is a variable choke sleeve, the method further comprising choking a fluid flow into the production tubing by incrementally moving the variable choke sleeve partially between the closed and open positions.

6. The method of claim 1, further comprising measuring a pressure differential between outside and inside of the outer completion string with the surveillance line and the control module.

7. The method of claim 1, further comprising measuring a temperature differential between outside and inside of the outer completion string with the surveillance line and the control module.

8. The method of claim 1, further comprising adjusting a fluid flow rate into the production tubing based on the fluid and/or well environmental parameters measured.

9. A method of deploying a single trip multizone completion system, comprising:

locating an inner service tool within an outer completion string arranged within an open hole section of a wellbore that penetrates one or more formation zones, the outer completion string having at least one sand screen arranged thereabout and a surveillance line arranged between the one or more formation zones and the at least one sand screen, wherein the surveillance line extends externally along the outer completion string;

treating the one or more formation zones with the inner service tool;

retrieving the inner service tool from within the outer completion string;

extending a production tubing within the outer completion string and communicably coupling the production tubing to the completion string at a crossover coupling having one or more control lines, the production tubing having at least one interval control valve and a control module associated with the at least one interval control valve and in communication with the one or more control lines, wherein the one or more control lines extend externally along the production tubing, and wherein the one or more control lines are arranged between the at least one sand screen and the production tubing;

communicably coupling the one or more control lines to the surveillance line upon coupling the production tubing to the completion string; and actuating the at least one interval control valve with the control module to initiate production into the production tubing at the at least one interval control valve.

10. The method of claim 9, further comprising:

measuring one or more fluid and/or well environmental parameters external to the outer completion string with the surveillance line; and measuring the one or more fluid and/or well environmental parameters within the outer completion string with the control module.

11. The method of claim 10, further comprising measuring a pressure differential between outside and inside of the outer completion string.

12. The method of claim 10, further comprising measuring a temperature differential between outside and inside of the outer completion string.

13. The method of claim 9 wherein treating the one or more formation zones comprises hydraulically fracturing and gravel packing the one or more formation zones.

14. The method of claim 9, further comprising opening a flow control device arranged within the at least one sand screen in order to facilitate fluid flow through the at least one sand screen from the one or more formation zones.

15. The method of claim 9, further comprising choking a fluid flow into the production tubing with the at least one interval control valve.

16. The method of claim 9, further comprising measuring compaction of a gravel pack in the one or more formation zones with one or more sensors and/or gauges coupled to the surveillance line.

17. The method of claim 9, further comprising monitoring the one or more formation zones for water break through or zonal depletion with the surveillance line.

18. The method of claim 9, further comprising anchoring the outer completion string within the wellbore with a top packer, the top packer being set in the wellbore axially above the crossover coupling.

19. The method of claim 9, further comprising:

detaching the production tubing from the outer completion string;

retrieving the production tubing to a well surface while the outer completion string remains within the wellbore adjacent the one or more formation zones;

re-locating the production tubing within the outer completion string; and communicably coupling the production tubing to the outer completion string at the crossover coupling once again.

* * * * *